United States Patent [19]

Elmasian

[11] 4,135,144

[45] Jan. 16, 1979

[54] TRAFFIC LIGHT RADIO CONTROL SYSTEM

[75] Inventor: Edward Elmasian, Bloomfield Hills, Mich.

[73] Assignee: David L. Kirk, a part interest

[21] Appl. No.: 774,811

[22] Filed: Mar. 7, 1977

[51] Int. Cl.[2] ..... G08G 1/00

[52] U.S. Cl. ..... 340/32; 343/228

[58] Field of Search ..... 340/32, 33, 34, 43; 325/111, 117, 312, 314; 343/228

[56] References Cited

U.S. PATENT DOCUMENTS

| | | | |
|---|---|---|---|
| 2,057,186 | 10/1936 | Freeberg | 340/43 |
| 2,355,607 | 8/1944 | Shepherd | 340/33 |
| 2,881,409 | 4/1959 | Cook et al. | 340/33 |
| 2,903,674 | 9/1959 | Schwab | 340/33 |
| 3,020,522 | 2/1962 | Lesher | 340/32 |
| 3,114,127 | 12/1963 | Ramsey | 340/32 |
| 3,257,641 | 6/1966 | Campana et al. | 340/33 |

*Primary Examiner*—Donald J. Yusko

*Assistant Examiner*—James J. Groody

*Attorney, Agent, or Firm*—Krass & Young

[57] ABSTRACT

A radio transmitter activated traffic signal control including a radio transmitter carried in the emergency vehicle and activated to transmit a signal to the traffic signal lights at each intersection approached by the emergency vehicle which in turn activates a relay within the traffic light controls which relay disconnects the normal sequencing controls to the traffic lights and activates a timer delay relay which initially energizes the red light in each traffic signal via a blinker to cause a flashing red signal to be activated at all lights and subsequently, after an adjustable time delay period ranging from 5 to 8 seconds, energizing each red light in a steady mode. After the transmitter signal is sufficiently attenuated by the emergency vehicle proceeding a sufficient distance beyond the intersection, the receiver-activated relay is again de-energized, causing the normal sequencing and timing controls of the traffic signal to again be connected to the traffic lights for normal operation.

3 Claims, 3 Drawing Figures

TRAFFIC LIGHT RADIO CONTROL SYSTEM

BACKGROUND OF THE INVENTION

1. Field of the Invention

This invention involves traffic signal controllers and more particularly a radio-activated traffic signal controller activated by an emergency vehicle for changing the mode of operation of the traffic signal so as to stop traffic in all directions as the emergency vehicle approaches the intersection.

2. Description of the Prior Art

Remote control of traffic signal systems by emergency vehicles in order to facilitate movement of emergency vehicles through traffic and reduce the hazard to the emergency vehicle and other traffic when emergency runs are being carried out has long been seen as a desirable feature of traffic signals. In most of these systems a radio, ultrasonic, or proximity-sensing-arrangement of some sort has been utilized to trigger an emergency mode for the traffic light controller, typically turning all of the lights red or alternatively the lights in the transverse direction to the approach of the vehicle red to facilitate movement of the emergency vehicles through the intersection.

Some variations of this concept have been proposed such as that disclosed in U.S. Pat. No. 3,257,641 which discloses a radio-activated system which triggers an emergency siren and an emergency light in conjunction with activating all of the red lights, as long as the emergency vehicle is within transmission range.

In U.S. Pat. No. 3,881,169 various permutations of this concept are proposed which includes activating all of the red lights in the signals to a flashing condition.

In another variation the cross street is activated to a blinking red condition, while the street down which the emergency vehicle is traveling has its amber lights activated in a flashing condition.

In U.S. Pat. No. 2,881,409, a system is disclosed in which the traffic signal is activated so as to initially flash yellow, then to a steady red, both in the cross street direction.

In U.S. Pat. No. 3,114,127, the radio-activated controller briefly flashes all of the lights red, while sequencing the normal traffic signal controls to obtain the right sense of the traffic signals to conform with the direction of approach of the emergency vehicle. At this point, the lights are maintained in this condition until the emergency vehicle passes.

Other typical systems are disclosed in U.S. Pat. Nos. 3,636,507, 2,203,871 and 3,209,325.

However, no such system has enjoyed widespread acceptance. It is felt that an overriding concern in the design of any such system is that the cost be held to a minimum and that this be done without compromising the reliability of the system, since traffic lights must be highly reliable to keep maintenance costs within reason and to avoid the resultant disruption of traffic which would result from the failure of the traffic signal to operate properly.

The systems described in these patents can all be characterized as being relatively complex and costly in design with undue elaborateness in the circuitry and in the control modes which would contribute, in no small part, to relatively high manufacturing installation costs and which would contribute to the maintenance problems described.

It is therefore an object of the present invention to provide such an emergency vehicle activated traffic light controller which is simple in design, while performing the essential functions required of such a device. In connection with this object it is also an object of the present invention to provide such a design which is readily incorporatable into the traffic signal control systems presently in use.

SUMMARY OF THE INVENTION

These, and other objects, which will become apparent upon a reading of the following Specification and Claims are carried out by a system including a radio transmitter-receiver combination which activates a relay which interacts with a second or master relay which disconnects the normal sequencer-controller circuitry from the power supply and energizes all of the signal red lights via timer delay relay contacts, which initially energizes each of the red lights via a blinker device to produce a flashing red signal, and after a predetermined adjustable delay on the order of 5 to 8 seconds, energizes each red traffic signal steadily. After the emergency vehicle has proceeded a sufficient distance past the intersection, the signal received by the radio receiver is sufficiently attenuated to cause de-energization of the control relay and resumption of normal sequencing and timing by virtue of reconnection of the sequencer-controller circuitry to the traffic lights.

DETAILED DESCRIPTION

In the following Specification and Claims certain specific terminology will be utilized for the sake of clarity and a particular embodiment described in accordance with the requirements of 35 USC 112, but it is to be understood that the same is not intended to be limiting and should not be so-construed, inasmuch as the invention is susceptible of many variations within the scope of the appended claims.

The present invention is contemplated as being incorporated into a conventional traffic signal of the type having a plurality of colored lights, i.e., red, amber and green which are sequenced in a time-controlled fashion to regulate the flow of traffic.

Figure 1:
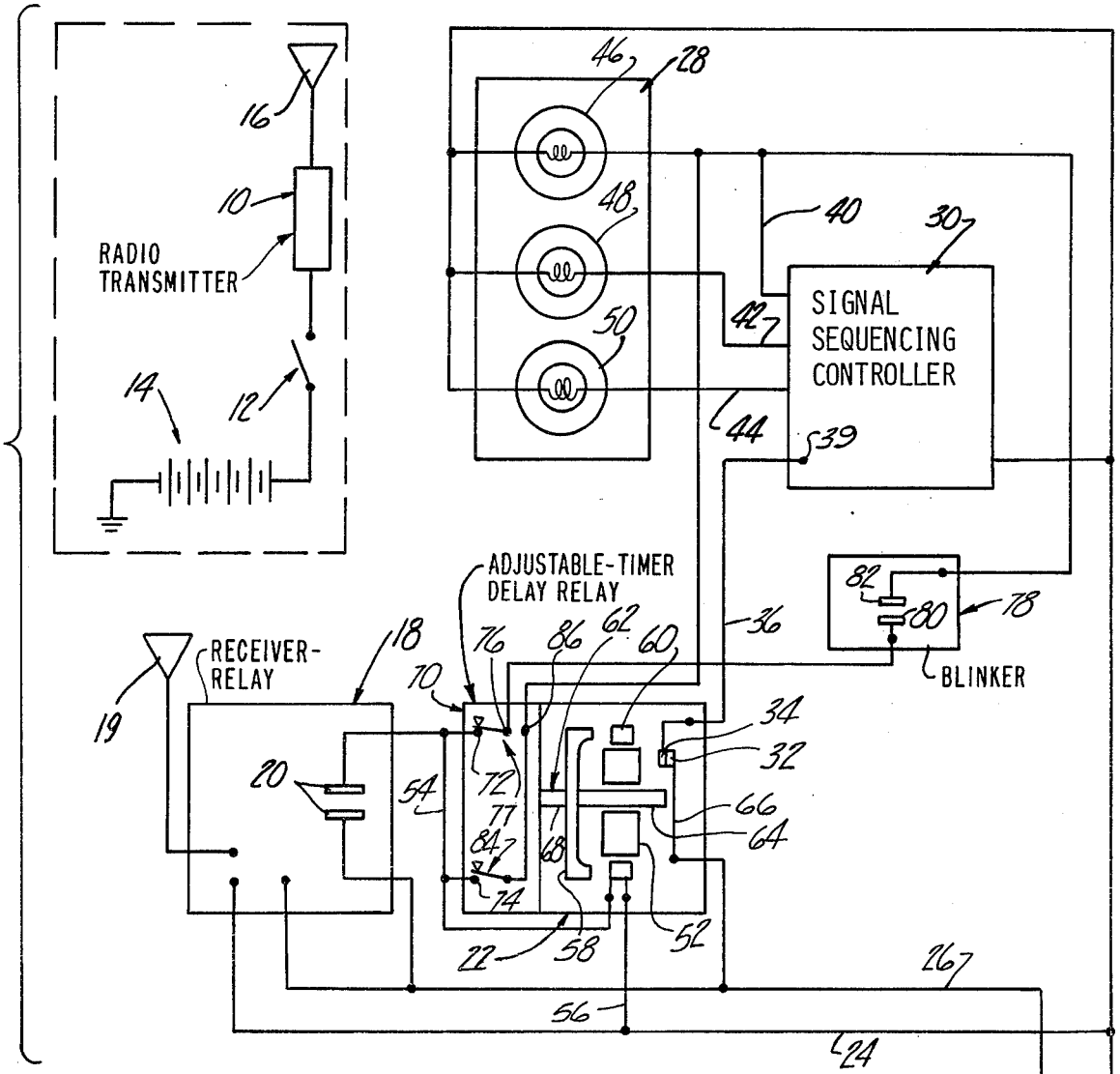
FIG. 1 is a diagrammatic representation of the circuitry according to the present invention and a diagrammatic representation of the traffic signal light associated with such circuitry in the normal mode of operation.

Referring to FIG. 1, the system according to the present invention includes a radio transmitter device 10 which would be carried within the emergency vehicle, with a dash mounted manually operated switch 12 adapted to control energization of the transmitter 10 by connection with the vehicle battery 14. The transmitter 10 transmits via antenna 16 a radio rf signal whenever the switch 12 is closed and does not transmit such signal when switch is open, as shown in FIG. 1. The system also includes a receiver-relay 18 carried within each traffic light signal mechanism.

The receiver-relay 18 is adapted to receive the signals emitted by the transmitter 10 via antenna 19 and close relay contacts 20 whenever signals are received of predetermined strength level. The contacts 20 are open, as shown in FIG. 1, in the absence of such radio signals. Power to supply the receiver-relay is provided by connection to G 110 V A/C source via lines 24 and 26, as shown in FIG. 1.

The transmitter 10 and receiver-relay 18, of course, would preferably include design features adapted to prevent false triggering or triggering by unauthorized transmitter devices, and for this purpose various frequency or other coding arrangements are well known, such as are used in connection with garage door openers, and other controlled access radio activated devices, etc., but the details of the same do not form a part of the present invention and, accordingly, are not here described. However, it should be understood that such features would be normally included in their design.

The receiver-relay 18 serves to control energization of a master relay 22 which in turn functions to control the connection of the 110 volt power supply applied to lines 24 and 26 to the sequencer-controller circuit 30 and the traffic signal 28 lights. One of the lines 24 is connected to the sequencer-controller circuit 30 and to the individual traffic signal lights of the conventional traffic light 28. The other line 26 of the input power supply is connected to switch contact 32 and via contact 34 and line 36 is connected to an input terminal 39 which serves to energize the sequencer-controller circuitry 30, so that when contacts 32 and 34 are closed, the operation of the traffic light 28 will be carried out in normal fashion via lines 40, 42, 44, associated with the red light 46, amber light 48 and green light 50, respectively.

Figure 2:
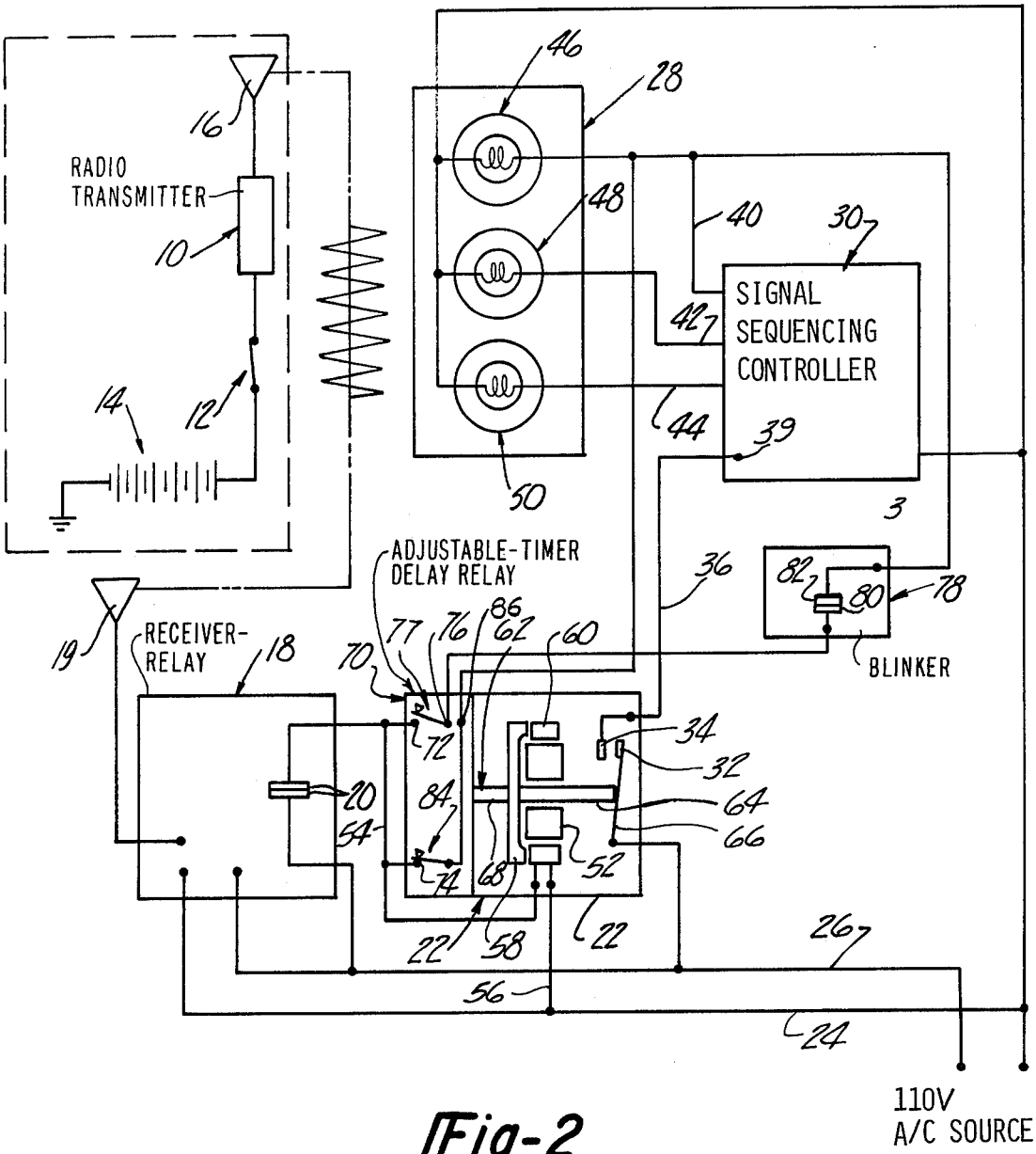
FIG. 2 is a diagrammatic representation of the system shown in FIG. 1 in which the emergency mode operation has been initiated.

As shown in FIG. 2, energization of the master relay coil 52 is controlled by activation of the receiver-relay 18, by connection of one line 26 from the power supply through closed contacts 20 and line 54. The other line 24 is directly connected to the coil 52 via line 56. Upon energization of the master relay coil 52, relay armature 58 is drawn axially to the right, as shown in FIG. 2, against a stop 60. Central shaft 62 integral with the armature 58 has a first extension portion 64 which engages a switch leaf 66, opening contacts 32 and 34 and interrupting power to the sequencer-controller circuit 30 to discontinue normal operation of the traffic signal 28. At the same time, another portion 68 of the armature shaft 62 activates a timer-relay section 70 of the master relay 22.

Timer-relay section 70 includes a pair of input terminals 72 and 74 connected to the output side of contacts 20 of the receiver-relay 18. A first output terminal 76 is normally connected via a switch means 77 to both input terminal 72 and to a blinker device 78. Blinker device 78 is a conventional interrupter which serves to cyclically open and close an input contact 80 connected to the timer-relay output terminal 76 and an output contact 82 directly connected to the red traffic signal light 46, so that upon energization of the receiver-relay 18, the red traffic signal light 46 is initially caused to flash red.

After a predetermined adjustable delay period of from 5 to 8 seconds, the timer-relay section 70 causes opening of switch means 77 and disconnection of the output terminal 76, and at the same time closes a second switch means 84 and connection of a second output terminal 86 to the output side of contacts 20. Terminal 86 is directly connected to the red traffic signal light 46, to bypass the blinker device 78, and cause a steady red condition to exist.

Upon opening of the contacts 20 by sufficient attenuation of the rf signal received by the receiver-relay 18, the timer-relay section 70 is reset by a spring return (not shown) of the relay armature 58, to allow reconnection of the normally closed switch means 77, to be in readiness for the next activation.

Details of the master relay 22 and the timer section 70 are not here included, since suitable commercial devices are available and at low cost to perform the described function, and do not comprise per se the present invention.

Figure 3:
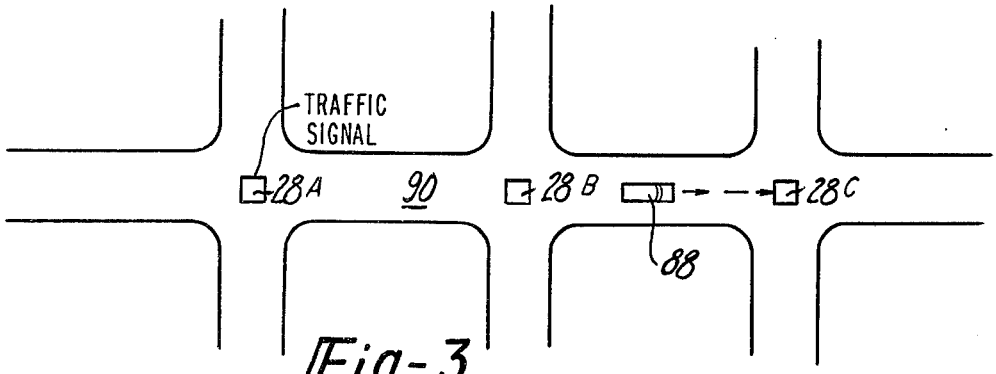
FIG. 3 is a diagrammatic representation of a series of intersections having traffic signals modified according to the present invention, and depicting the sequencing of the signals from emergency to normal mode as the vehicle proceeds through these intersections.

Referring to FIG. 3, there is depicted the operation of the control system as an emergency vehicle proceeds through a series of intersections at which are installed traffic signal lights incorporating controllers according to the present invention.

In this representation, an emergency vehicle 88 is proceeding down a thoroughfare 90, and has passed a sufficient distance from a first traffic signal 28 A to allow resumption of normal operation.

At the same time, the emergency vehicle 88 has just passed a second traffic signal 28 B which is thus in a steady red condition, and is approaching a third traffic signal 28 C to trigger that signal to a flashing red condition.

Accordingly, it can be appreciated that the system set forth above can be characterized as extremely simple in implementation, such as to accomplish the objects of the present invention including only conventional relays which are commercially available at low cost and are highly reliable in operation.

The embodiments of the invention in which an exclusive property or privilege is claimed are defined as follows:

1. In a traffic signal light system of the type including a plurality of traffic lights of different color and including sequencing and timing circuitry and power supply therefor operative to produce energization of said plurality of lights in a predetermined time pattern to thereby regulate traffic flow, the improvement comprising: an emergency vehicle activated controls for said plurality of lights, said controls including first relay means having contacts in series between the power supply means for said sequencing and timing circuitry, said first relay means contacts being normally closed to allow energization of said sequencing and timing circuitry by said power supply, said first relay means further including means disconnecting said sequencing and timing circuitry and said power supply means upon energization of said first relay means and opening of said contacts; radio transmitter means selectively operated and adapted to be carried by an emergency vehicle; radio receiver-relay means adapted to be activated by said radio transmitter means and operative when activated to activate said first relay means to disconnect said power supply means from said sequencing and timing circuitry means by opening of said contacts; delay-relay means having an input terminal means; a first output terminal means adapted to be connected to said input terminal means upon activation of said delay-relay means for a predetermined time period of short duration; second output terminal means adapted to be connected to said delay-relay input means upon disconnection of said first terminal means and continuously activated as long as said delay-relay means is activated; means activating said delay-relay means in response to activation of said receiver-relay means; blinker means including a pair of contacts and adapted to provide a cyclical make and break of said contacts; means connecting said first output terminal means of said delay-relay means to one of said blinker means contacts, the other of said blinker means contacts connected to one of said traffic lights, said second output terminal means connected to one of said traffic lights; means connecting said power supply means to said input terminal means of said delay-relay means upon activation of said receiver-relay means; whereby when said receiver-relay is energized, one of said traffic lights is initially cyclically energized via said blinker means by connection of said power supply via said first output terminal means and then by said connection to said second output terminal means, one of said traffic lights is steadily energized.

2. The traffic signal control arrangement according to claim 1 wherein said delay-relay means comprises an adjustable timer delay-relay means.

3. The arrangement according to claim 1 wherein said traffic light includes red, amber and green lights controlled by said sequencing and timing circuitry means and wherein said first input terminal means associated with said delay-relay means connects said power supply with said red light, whereby said traffic signal is initially operated in the flashing red mode and subsequently caused to be energized in a steady condition upon activation of said receiver-relay means by said transmitter means carried by an emergency vehicle.

* * * * *